US005713533A

United States Patent [19]

Nordlof et al.

[11] Patent Number: 5,713,533

[45] Date of Patent: Feb. 3, 1998

[54] STOCK FEED APPARATUS

[75] Inventors: Richard D. Nordlof; Kenneth J. Lauterbach, both of Rockford, Ill.

[73] Assignee: Mechanical Tool & Engineering Co., Rockford, Ill.

[21] Appl. No.: 709,719

[22] Filed: Sep. 9, 1996

[51] Int. Cl.[6] ..... B65H 23/18; B65H 23/06; B23Q 15/00

[52] U.S. Cl. ..... 242/418.1; 226/42; 226/45; 242/420.6; 242/564.3

[58] Field of Search ..... 226/24, 42, 43, 226/44, 45; 242/413.5, 413.6, 418.1, 420.6, 564.3

[56] References Cited

U.S. PATENT DOCUMENTS

| | | | |
|---|---|---|---|
| 2,907,565 | 10/1959 | Sauter . | |
| 3,156,397 | 11/1964 | Davies . | |
| 3,177,749 | 4/1965 | Best et al. . | |
| 3,236,429 | 2/1966 | Klein . | |
| 3,240,411 | 3/1966 | Zarleng . | |
| 3,771,114 | 11/1973 | Buchan et al. . | |
| 3,832,036 | 8/1974 | Ashida et al. | 226/44 |
| 4,205,769 | 6/1980 | Blitchington | 226/24 |
| 4,297,586 | 10/1981 | Rogers . | |
| 4,384,665 | 5/1983 | Waddington . | |
| 4,437,619 | 3/1984 | Cary et al. . | |
| 4,500,043 | 2/1985 | Brown | 242/413.6 |
| 4,578,621 | 3/1986 | Nordlof . | |
| 4,804,898 | 2/1989 | Nordlof et al. . | |
| 4,996,541 | 2/1991 | Mori et al. | 226/44 |
| 5,499,878 | 3/1996 | Morgavi | 242/413.6 |

*Primary Examiner*—Daniel P. Stodola
*Assistant Examiner*—Matthew A. Kaness
*Attorney, Agent, or Firm*—Vernon J. Pillote

[57] ABSTRACT

A motor driven stock feed apparatus for feeding stock along a lengthwise path to maintain a slack loop in the stock. A loop size sensor includes four vertically spaced infrared beam emitters mounted at one side of an upright plane containing the lengthwise path of strip stock and four vertically spaced infrared beam sensors mounted at an opposite side of the upright plane. The infrared beam emitters are operated to emit a continuous train of pulses. A missing pulse detector associated with each infrared beam sensor senses missing pulses in the train of pulses received by the beam sensor and operates a motor speed control to increase and decrease the speed of the stock feed apparatus.

19 Claims, 4 Drawing Sheets

P
TX
20a
20b
20c
20d
PG
30
RX
21a
21b
21c
21d
P/R
40
40a
40b
40c
40d
MPD
50a
50b
50c
50d
F
60a
60b
60c
60d
ONE SHOT
70a
70b
70c
70d
JK FLIP FLOP
90a
90d
SW1
100a
SW2
100d
APR
110
PUR
105
SET
115
JOG
98
95
96
86
85
84
80
81
78
88
87
104
102
111
116
117
X
Y
Z

STOCK FEED APPARATUS

BACKGROUND OF THE INVENTION

The invention relates to stock feed apparatus for feeding strip stock to or from a stock processing machine to maintain a slack loop in the stock.

In the feeding of strip stock to or from a stock processing machine such as a punch press, it is common practice to operate the stock feed apparatus to maintain a slack loop in the stock in order to accommodate the intermittent transfer of the stock through the processing machine. The stock feed apparatus may comprise a power operated stock payout or rewind reel that effects advance of the stock by winding or unwinding stock from a coil. The stock feed apparatus may also comprise powered stock feed rollers or powered stock straightening rollers.

Various systems have heretofore been made for sensing the size of the stock loop and for driving the stock feed apparatus in a manner to maintain the stock loop between predetermined limits. In some systems, such as disclosed in U.S. Pat. No. 4,578,621, a stock loop sensor in the form of a dancer arm is arranged to sense the size of the stock loop and produce an analog control voltage for driving the stock feed apparatus at a speed correlative with the size of the stock loop, to maintain the stock loop within predetermined limits. However, the dancer arm directly engages the stock in the loop and can damage or mar some types of stock. Non-contacting type stock loop sensors, for example capacitance type and sonic type sensors such as disclosed in U.S. Pat. Nos. 3,156,397; 3,771,114; 4,384,665; 4,437,619 and 4,804,898 have been made in which the stock loop sensors are disposed in an upright plane containing the lengthwise path of the strip stock at locations above and below the stock in the loop, to sense changes in the vertical spacing between the stock loop and the sensors. Some other non-contact type stock loop sensors such as photoelectric type stock loop sensors disclosed in U.S. Pat. Nos. 2,907,565; 3,177,749; 3,236,429; 3,240,411 and 4,297,586, provide a plurality of light emitters arranged in an upright plane containing the lengthwise path of movement of the strip stock and a plurality of light sensors arranged in the same upright plane and spaced horizontally from the light emitters a distance to allow the stock to form a loop between the beam emitters and the beam sensors. In such systems, the number of light sensors that are light-blocked by the stock loop increases as the size of the stock loop increases and conversely decreases as the size of the stock loop decreases. In order to reduce the horizontal spacing between the light emitters and the light sensors required to accommodate the stock loop the stock is sometimes passed over guides or through bins arranged so that the descending and ascending legs of the stock loop extend generally vertically and in relatively closely spaced relation. However, the guides and bins contact the stock and can damage or mar some types of stock.

SUMMARY OF THE INVENTION

It is an object of the present invention to provide a stock feed apparatus having a means for sensing the size of the stock loop which does not require support or contact with the stock as it passes through the stock loop.

A more particular object of the present invention is to provide a stock feed apparatus in which the stock loop sensing means includes a plurality of vertically spaced beam emitters mounted-at one side of an upright plane containing the lengthwise path of the strip stock and a plurality of vertically spaced beam sensors mounted at an opposite side of said upright plane and spaced from the beam emitters in a direction crosswise of the upright plane. The beam emitters and beam sensors are arranged in emitter-sensor pairs with the emitter of each emitter-sensor pair vertically offset from the beam sensor and configured such that a line between the beam emitter and the beam sensor of each emitter-sensor pair extends across the upright plane at an acute angle to the horizontal.

With the beam emitters and beam sensors spaced from opposite sides of an upright plane containing the lengthwise path of movement of the strip stock, the stock loop passes between the beam emitters and the beam sensor and it is not necessary to support or contact the stock as it passes from the stock loop sensor. Arranging the beam emitters and beam sensors such that a line between the beam emitter and beam sensor of each emitter-sensor pair extends across the upright plane at an acute angle to a horizontal plane, assures more reliable sensing of even very thin stock. Further, the beam emitters and beam sensors need only be spaced apart a distance sufficient to accommodate the maximum width of the stock, with some clearance from the edges of the stock.

With the beam emitters and the beam sensors disposed at opposite sides of an upright plane containing the lengthwise path of the strip stock, the strip stock interrupts the beam between only one emitter-sensor pair at a time. The emitter-sensor pairs are preferably arranged with a first control emitter-sensor pair located above a preselected loop reference level, and a second control emitter-sensor pair located below the preselected loop reference level. The motor control means includes a first means operative when the stock loop interrupts the beam between the first control emitter-sensor pair for producing a first control signal, and a second means operative when the stock loop interrupts a beam between the second control emitter-sensor pair for producing a second control signal, and means including ramp and hold circuit means responsive to the first and second control signals for producing a motor control output representative of the difference between the first and second control signals.

The emitter-sensor pairs also include a first limit emitter-sensor pair at an upper loop limit and a second limit emitter-sensor pair at a lower loop limit, and the motor control means includes a first limit means operative when the stock loop interrupts the beam between one of the limit emitter-sensor pairs for applying a preset run voltage to the motor and a second limit means operative when the stock loop interrupts the beam between the other of the limit emitter-sensor pairs for reducing the motor voltage to zero.

The beam emitters are advantageously infrared beam emitters and the beam sensors infrared beam sensors.

Pulse generator means energizes the beam emitters to transmit a train of pulses at a preselected high frequency and the motor control means includes means individual to each emitter-sensor pair for detecting missing pulses in the train of pulses transmitted from the beam emitter to the beam sensor of each emitter-sensor pair.

DETAILED DESCRIPTION

Figure 1:
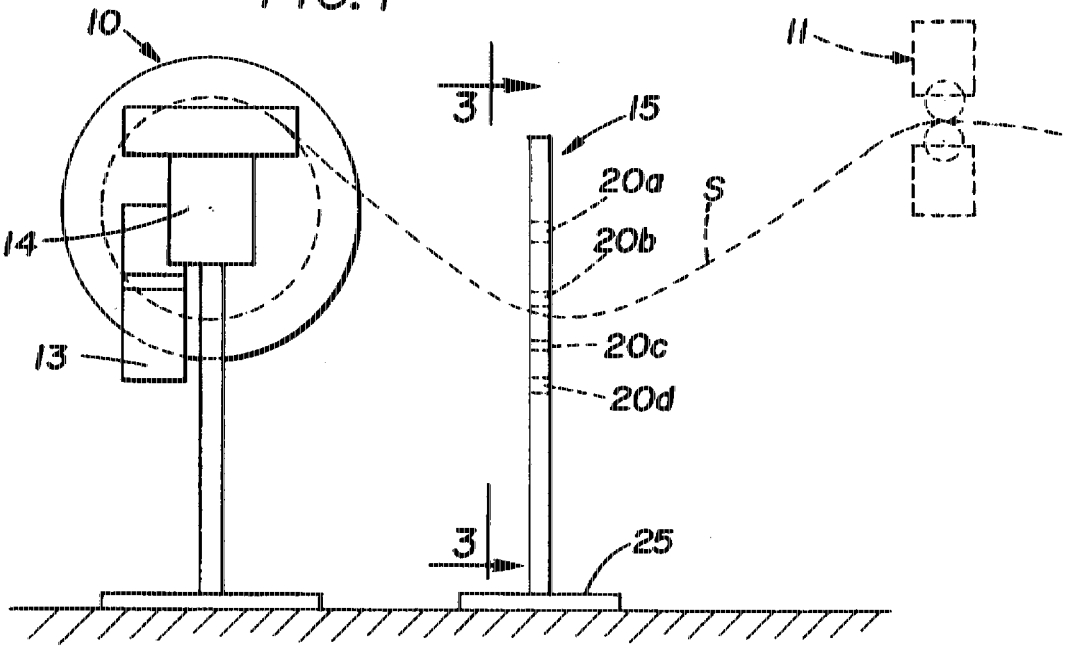
FIG. 1 is a diagrammatic view of illustrating a stock feed apparatus having a stock loop sensor of the present invention for sensing slack in a stock loop between a stock reel and a wire processing machine.
Figure 4:
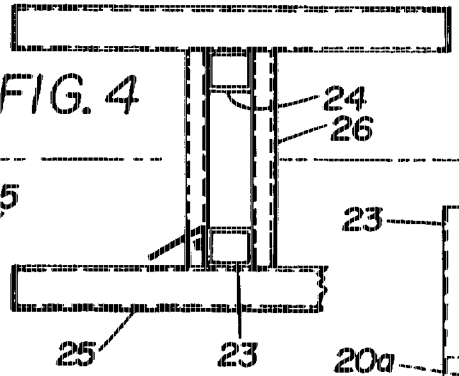
FIG. 4. is a top view of the stock loop sensing apparatus.
Figure 2:
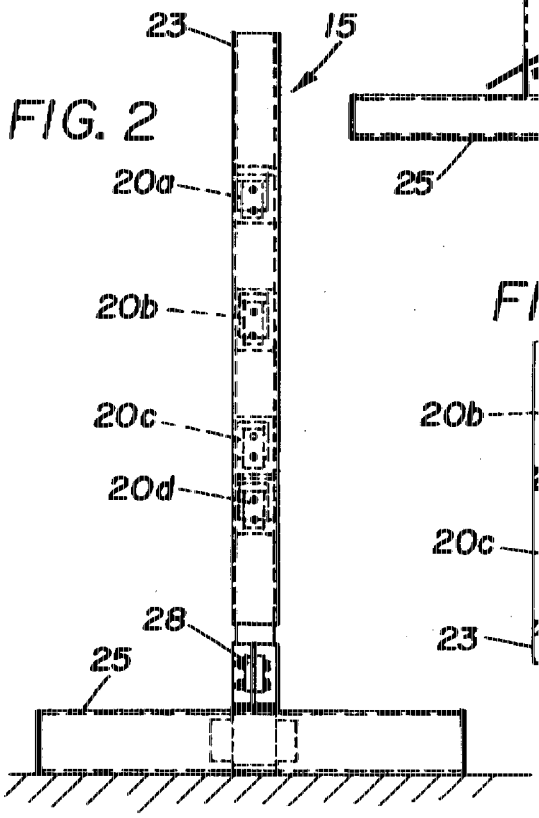
FIG. 2. is a side elevational view of the stock loop sensing apparatus.
Figure 5:
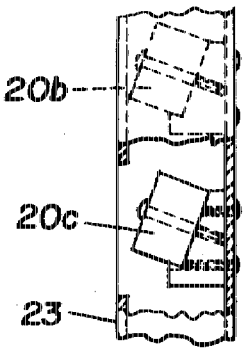
FIG. 5. is a fragmentary enlarged view with parts broken away to illustrate details of construction of the stock loop sensing apparatus.

The present invention relates to a stock feed apparatus for feeding strip stock or wire to or from a stock processing machine to maintain a slack loop in the stock. The stock feed apparatus 10 diagrammatically illustrated in FIG. 1 is in the form of a stock reel which is adapted to feed stock S to or from a stock processing machine such as a punch press (not shown) having a press feed designated 11 for intermittently advancing stock through the processing machine. While the stock feed apparatus is herein illustrated in the form of a powered stock reel, it is to be understood that the stock feed apparatus could also comprise powered stock feed rollers or powered stock straightening rollers. The stock feed apparatus 10 is driven by a drive motor 13 through a speed reducer drive 14 at a speed correlative with the speed of the motor and loop sensing means 15 is provided for sensing the size of the loop in the stock between the feed apparatus 10 and the press feed 11.

Figure 3:
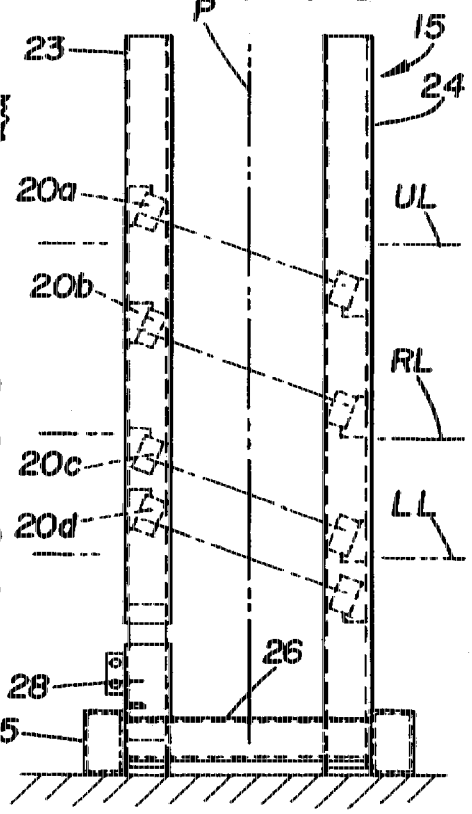
FIG. 3. is an elevational view taken on the plane 3—3 of FIG. 1.

The stock loop sensing means 15 includes a plurality of vertically spaced beam emitters, preferably four in number and designated 20*a*–20*d* mounted on a upright post 23 at one side of an upright plane P containing the lengthwise path of movement of the strip stock, and a plurality of vertically spaced beam sensors 21*a*–21*d* mounted on an upright post 24 at an opposite of the upright plane P and spaced from the emitters in a direction crosswise of the upright plane. The beam emitters and beam sensors are arranged in emitter-sensor pairs with the beam emitters 20*a*–20*d* vertically offset from the associated beam sensor 21*a*–21*d* of each pair. As best shown in FIG. 3, the emitters and sensor are mounted on the associated supports 23 and 24 at an angle such that a beam line between the emitter and the sensor of each emitter-sensor pair extends across the upright plane P at an acute angle to the horizontal. As shown in FIG. 3, the beams emitted from beam emitters 20*a*–20*d* extend-crosswise of the upright plane P at a shallow acute angle, preferably in the range of three to ten degrees to the horizontal. The posts 23 and 24 are mounted on a base including legs 25 and cross members 26, and the post 23 that supports the beam emitters as preferably attached by a connector 28 to the base that will enable the post 23 to be vertically and angularly adjusted relative to the base to facilitate alignment of the beams from the beam emitters on post 23 with the beam sensors on post 24.

One of the emitter-sensor pairs comprising beam emitter 20*b* and beam sensor 21*b*, is located above a preselected loop reference level designated RL, and beam sensor 21*b* is hereinafter sometimes referred to as the first control beam sensor. One other emitter-sensor pair comprising beam emitter 20*c* and beam sensor 21*c*, is located below the loop reference level RL. and beam sensor 21*c* is hereafter sometimes referred to as a second control beam sensor. A third emitter-sensor pair comprising beam emitter 20*a* and beam sensor 21*a* is located at an upper loop limit designated UL and beam sensor 21*a* is hereinafter sometimes referred to as a first limit beam sensor. A fourth emitter-sensor pair comprising beam emitter 20*d* and beam sensor 21*d* is located at a lower loop limit designated LL and beam sensor 21*d* is hereinafter sometimes referred to a second limit beam sensor.

Figure 6:
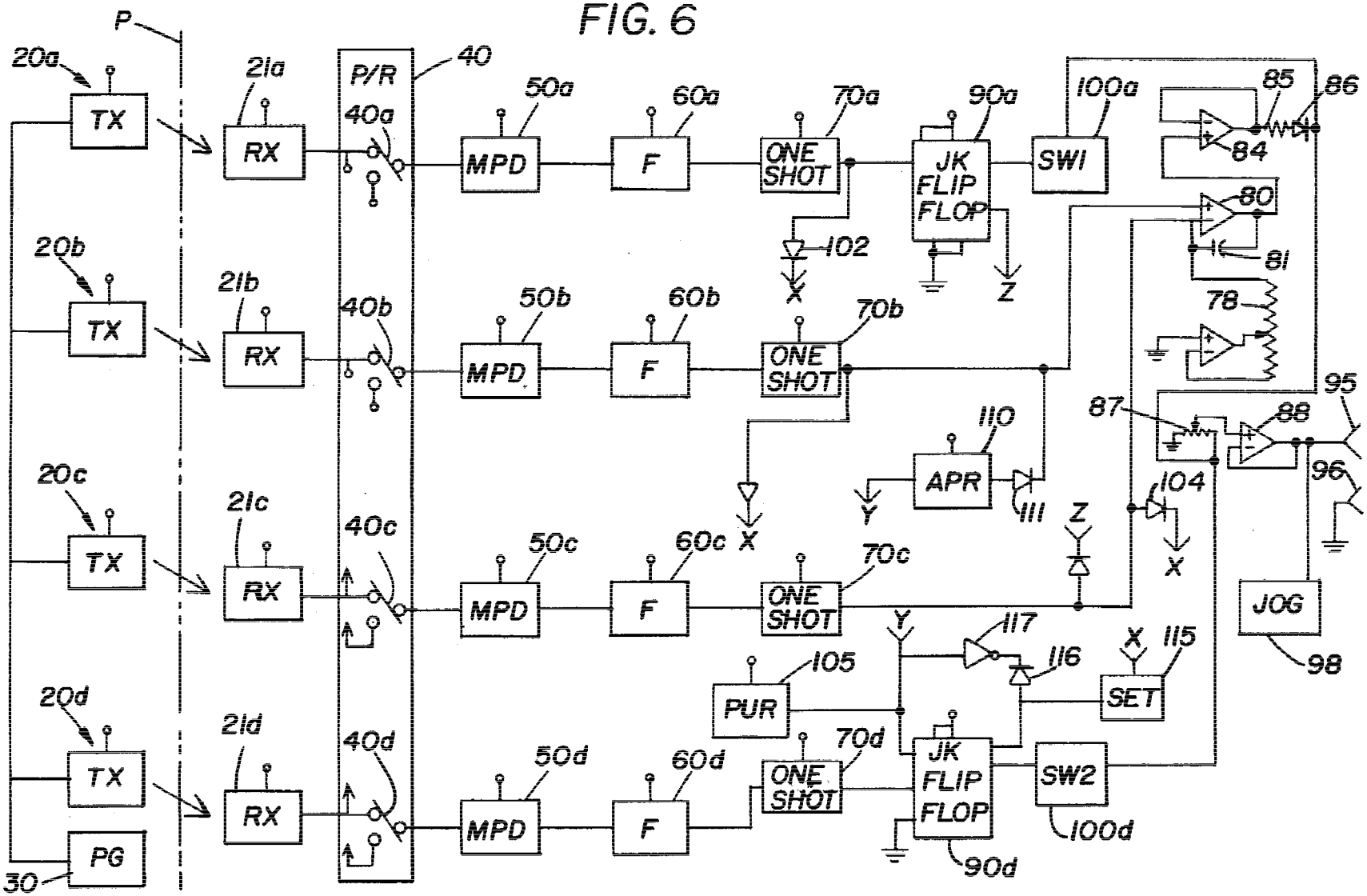
FIG. 6. is a block diagram of a motor control circuit responsive to the loop size sensing means for controlling the motor speed of the stock feed apparatus.

The beam emitters 20*a*–20*d* labeled TX in FIG. 6, are preferably infrared emitting diodes that are pulsed by a pulse generator or oscillator 30 labeled PG in FIG. 6. The beam sensors labeled RX in FIG. 6, are infrared beam sensors and the beam sensors 21*a*–21*d* produce a pulsed output correlative with the frequency of the pulsed beam from the associated beam emitter. The infrared emitting diodes, are preferably pulsed at a high frequency, for example about 12,500 CPS with period of 80 micro-seconds and a pulse width about 10 micro-seconds. The infrared beam sensors are infrared light-to-voltage optical sensors such as marketed by Texas Instruments, Inc. under the designation TSL 262. The infrared sensors preferably have a visible light cutoff filter.

When a light beam from a beam emitter to the associated beam sensor is interrupted even momentarily, the beam received by the beam sensor will contain one or more missing pulses. Four missing pulse detectors 50*a*–50*d* are provided to detect a missing pulse or an abnormally long spacing between consecutive pulses in a train of pulses. In order to adapt the stock loop sensing means to control the stock feed apparatus in either a payout or a rewind mode, a payout-rewind switch 40 labeled P/R in FIG. 6, is provided for connecting the beam sensors 21*a*–21*d* to selected ones of the missing pulse detectors 50*a*–50*d*, labeled MPD in FIG. 6. As diagrammatically illustrated in FIG. 6, the payout-rewind switch is a four pole double-throw switch having switches 40*a*, 40*b*, 40*c* and 40*d*. In a first or payout position, switches 40*a*–40*d* connect beam sensors 21*a*, 21*b*, 21*c* and 21*d* respectively to missing pulse detectors 50*a*, 50*b*, 50*c* and 50*d*. In a second or rewind position, the payout-rewind switch 40 is arranged by suitable jumpers (not shown) to connect the first limit beam sensor 21*a* to the missing pulse detector 50*d*; to connect the first control beam sensor 21*b* to the missing pulse detector 50*c*; to connect the second control beam sensor 21*c* to the missing pulse detector 50*b*, and to connect the second limit beam sensor 21*d* to the missing pulse detector 50*a*.

The missing pulse detectors produce an output pulse when even a single pulse is missing from the train and, in order to reduce cycling of the speed control, the output pulses from the missing pulse detectors 50*a*–50*d* are applied through filters 60*a*–60*d* respectively labeled F in FIG. 6, to monostable one-shot timers 70*a*–70*d* labeled one-shot in FIG. 6. The filters are configured to delay triggering the associated one-shot timer for a time interval corresponding to a plurality of missing pulses, for example five to ten missing pulses.

The one-shot timers 70*b* and 70*c* are associated with the control beam sensors 21*b* and 21*c* and one-shot timers 70*b* and 70*c* are hereinafter sometimes referred to as control one-shot timers. The outputs of one-shot timers 70*b* and 70*c* are applied to a ramp and hold circuit 79 to produce an analog output voltage that respectively increases and decreases in response to the output pulses from timers 70*b* and 70*c*. The ramp and hold circuit includes a difference amplifier 80, an integrating capacitor 81 connected between the output and the inverting input of the amplifier 80, and a null amplifier 82. The null amplifier has a non-inverting input connected to ground, an inverting input connected through a voltage divider 78 to the integrating capacitor 81, and an output connected to a tap on the voltage divider 78 to adjust drift of the integrating capacitor. The output of the difference amplifier 80 is connected to the inverting input of a voltage follower amplifier 84, and the outlet of amplifier 84 is connected through a resistor 85 and diode 86 to an adjustable voltage divider 87. The adjustable tap of the voltage divider 87 is connected to the non-inverting input of a voltage follower amplifier 88 and the output of the voltage follower amplifier 88 is connected to terminal 95 of an output terminal set 95, 96 adapted for connection to a motor controller (not shown) for drive motor 13. Motor controllers suitable for use in controlling operation of fractional horsepower DC motors are well known and commercially available from various manufacturers and may for example be of the type marketed by KB Electonics, Inc. of Brooklyn, N.Y. under the tradename KB1C solid state DC Motor speed control. A manually operable jog circuit 98 labeled Jog in FIG. 6, is provided to facilitate start-up.

The control one-shot timers **70*b* and 70*c* produce output pulses of preset amplitude and duration, and the difference amplifier 80 and integrating capacitor 81 form a difference integrator that produces an output analog voltage correlative with the difference between the output pulses from the one-shot timers 70*b* and 70*c*, to variably control the speed of the motor. The output pulse of one-shot timer 70*b* increases the motor speed and the output pulse of one-shot 70*c* decreases the motor speed and, the duration of the output pulses of one-shot timer 70*b* are preferably made slightly longer than the output pulses from one-shot timer 70*c* to gradually change the speed of the motor in a manner that tends to cause the stock loop to shift between the control pulse sensors 21*b* and 21*c***.

The one-shot timer **70*a* is connected to the clock input of a J-K flip-flop 90*a* that is operative when triggered to turn on an NPN transistor switch 100*a* labeled SW1 and apply a preset voltage to the voltage divider 87 for running the motor at a selected upper speed. One-shot timer 70*d* is connected to the clock input of a J-K flip-flop 90*b* that is operative when triggered, to turn on an NPN transistor switch 100*b* labeled SW2 in FIG. 6, to ground the voltage divider 87** and reduce the voltage to the feed drive motor to zero.

Provision is made for turning the switch **100*b*** to an off condition when the motor control means is initially turned on and also when any one of the one-shots *70a*, **70*b* and 70*c* are triggered. A power-up reset circuit 105 labeled PUR in FIG. 6 is connected to the reset terminal of J-K flip-flop 90*b*, to turn the switch 100*d* off when power is initially applied to the power-up reset. In addition, the output of one-shot timers 70*a*, 70*b* and 70*c* are connected as indicated at X and through diodes 102, 103 and 104 respectively to the trigger input of a set one-shot 115 labeled Set in FIG. 6, the output of which is connected to the set input of J-K flip-flop 90*b*. The output of one-shot timer 70*c* is also connected as indicated at Z through a diode 109 to the reset input of J-K flip-flop 90*a*, to turn the switch 100*a* off when the one-shot timer 70*c* is triggered. In order to expedite bringing the motor 13 up to a desired speed after it is been shut off, an adjustable preset ramp circuit 110 labeled APR in FIG. 6, is provided and connected through a diode 111 to the non-inverting input of difference amplifier 80 to ramp the output of amplifier 80 up to a selected voltage. The input trigger of the adjustable preset ramp 110 is connected as indicated at Y to the output of the power-up reset circuit 105. The power-up reset is also connected through an inverter 117 and a diode 116 to the set terminal of J-K flip-flop 90*d* to inhibit actuation of the set input of J-K-flip-flop 90*d* by any one of the one-shot timers 70*a*, 70*b* and 70*c* during reset of J-K flip-flop 90*d***.

Figure 7:
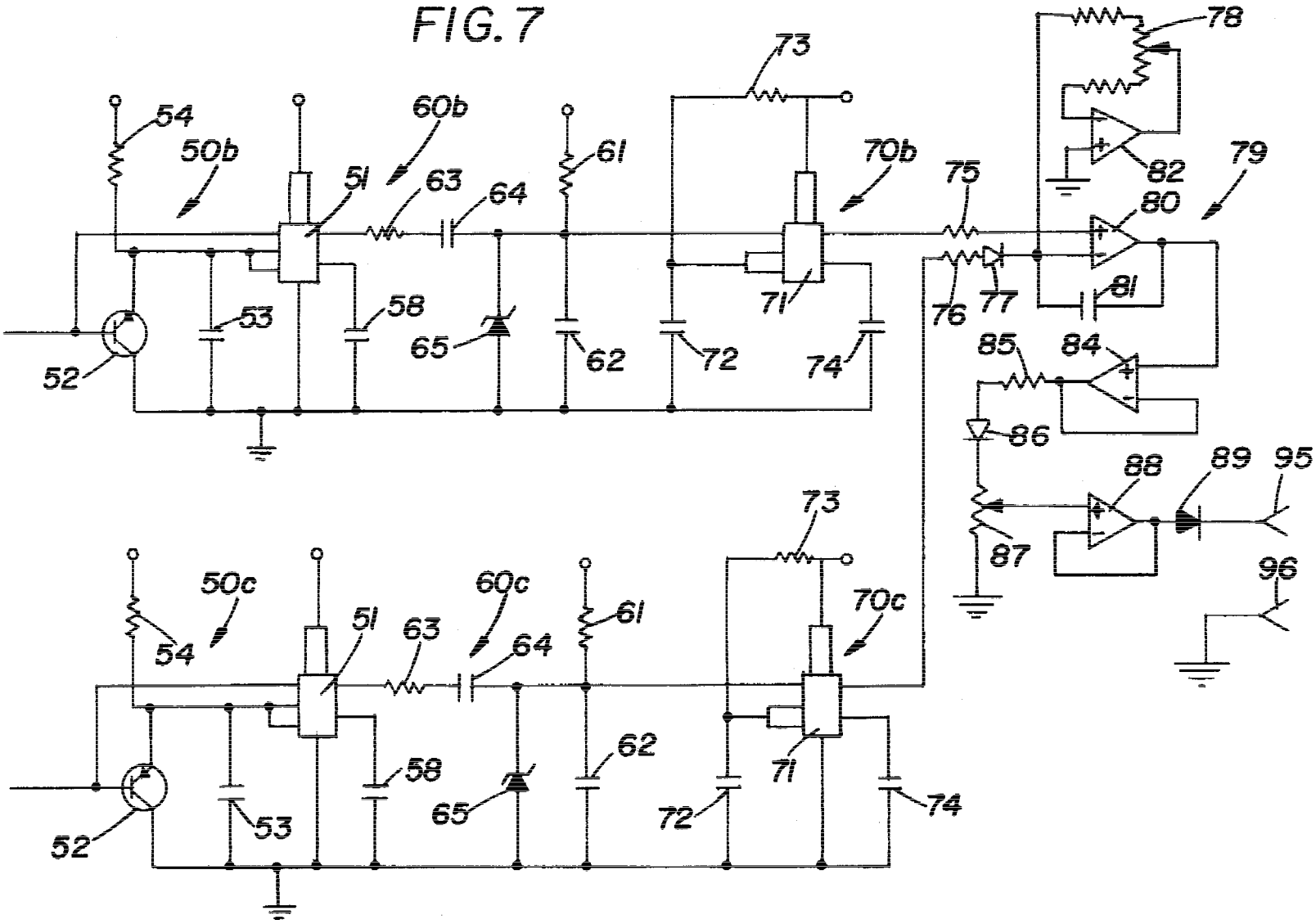
FIG. 7. is a schematic diagram of the motor speed control circuits associated with two control emitter-sensor pairs located above and below a preselected loop reference level.

The missing pulse detectors **50*a*–50*d* are of like construction and the missing pulse detectors 50*b* and 50*c* associated with the first and second control beam sensors are schematically illustrated in FIG. 7. The missing pulse detectors each use a 555 timer 51. A transistor 52 is connected with the collector grounded and the emitter tied to the discharge and threshold pins of the timer 51. The transistor base is connected to the trigger input of the timer 51. A capacitor 55 is connected in parallel with the emitter-collector of transistor 52 and a resistor 54 is connected to the capacitor 53 and forms a timing circuit that is selected to have a running frequency slightly lower than the frequency of the pulses sensed by the associated beam sensor, but not less than one-half the frequency of the incoming pulses. A by-pass capacitor 55 is connected to the control voltage terminal of timer 51 and ground for noise immunity. With this arrangement, the incoming pulses continually reset the timing cycle, but a missing timing pulse allows the timing cycle to be completed and generate an output pulse. As graphically illustrated in FIG. 8**, while the input of the missing pulse detector receives a train of pulses diagrammatically illustrated as blocks PT1, PT2, PT3 and PT4 on the pulse train diagram designated IMPD, the output of the missing pulse detector is high as indicated at H1, H2, H3 and H4 on the diagram designated OMPD. However when there are one or more missing pulses, the output of the missing pulse detector indicated by curve OMPD goes low as indicated at L1, L2, and L3 and remains low until the missing pulse detector again receives pulses at which time the output of the missing pulse detector again than goes high. Thus, the missing pulse detector is triggered each time there is even a single missing pulse.

Filters **60*a*–60*d* are provided between the missing pulse detectors and the one-shot timers 70*a*–70*d*, to prevent triggering of the one-shots when the pulse train is interrupted by only one or a few pulses, such as may occur due to a fluttering or vibration of the stock in the stock loop. As shown in FIG. 7, the filters each include a resistor 61 and a capacitor 62 connected between a positive voltage supply and ground, and the output of each missing pulse detector is applied through a resistor 63 and capacitor 64 to the capacitor 62. A Zener diode 65 is connected in parallel with the capacitor 62 to limit peak voltage applied to the capacitor. As indicated in the curve designated OF in FIG. 8, the output of the filter is high as indicated at F1, and the filter delays discharge of the condenser 62 for a time interval corresponding to a preselected minimum number of pulses as indicated at F2, for example five to ten missing pulses, before the condenser discharges to a voltage indicated at F3 corresponding to the trigger voltage of the one-shot timer. When the output of the missing pulse detector thereafter goes high, the output of the filter will also go high as indicated at F4 until the output of the missing pulse detector again goes low as indicated at L2 in the output curve of the missing pulse detector. If the number of missing pulses in the train of pulses is less than a preselected minimum number as indicated between pulse trains PT2 and PT3, the time interval between the output pulses H2 and H3 of the missing pulse detector will be insufficient to allow the filter to discharge to the trigger voltage of the one-shot timers as indicated at F5 in diagram OF in FIG. 8**.

Figure 8:
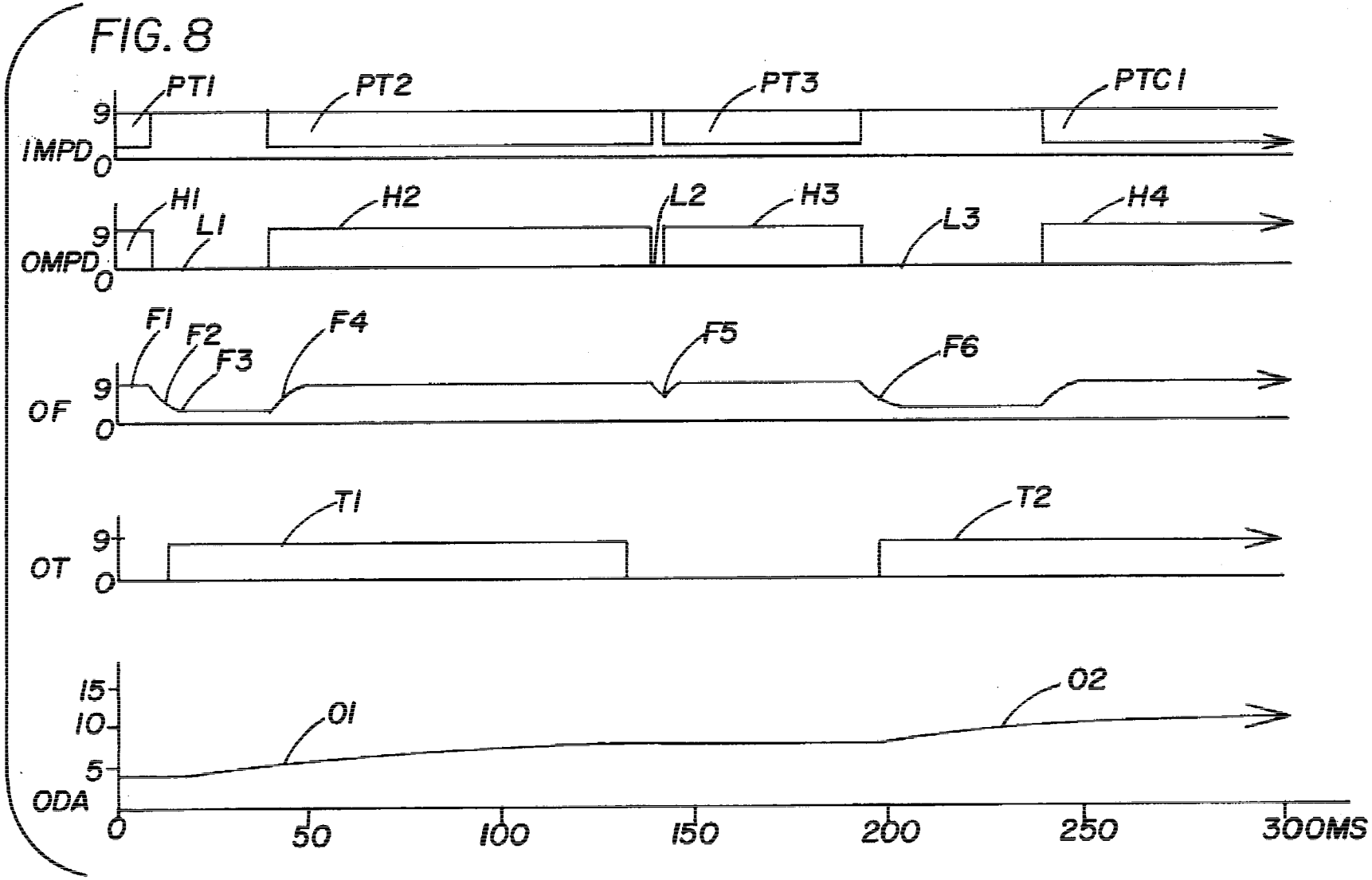
FIG. 8. graphically illustrates wave forms at different locations in the control circuit associated with one of the beam sensors.

The one-shot timers **70*b* and 70*c* associated with filters 60*b* and 60*c* are shown in FIG. 7. The one-shot timers 70*a* and 70*b* are preferably 555 timers 71 configured to form a triggered mono-stable one-shot having a preselected pulse amplitude and duration. A capacitor 72 has one end connected to the discharge and threshold terminals of the timer 71 and the other end connected to ground, and a resistor 73 is connected between a voltage supply and capacitor 72 to form a timing circuit. A by-pass capacitor 74 is connected between the control voltage terminal of timer 71 to ground, for noise immunity. When the voltage from the timer output circuit decreases to about one-third of the supply voltage, the timer 71 is triggered and the output goes high as indicated at T1 in the diagram labeled OT in FIG. 8, and the output will remain high for a time interval determined by the time constant of the timing circuit comprising resistor 73 and capacitor 72. For reasons pointed out hereinafter, the one-shot timer 70*b* is configured to have an output pulse duration slightly longer than the pulse duration of the one-shot timer 70*c*. In FIG. 8, the one-shot timer 70*b* is graphically illustrated having an output pulse duration of about 120 milliseconds. The output pulse duration of the one-shot timer 70*c*** is preferably configured to be slightly less for example about 100 milliseconds.

As previously described, the filters **60*a*–60*d* delay discharge of the capacitor 62 for a time interval corresponding to a preselected minimum number of pulses, for example five to ten missing pulses. The time interval indicated in curve IMPD in FIG. 8 between pulse trains PT2 and pulse train PT3 is less than preselected minimum number of missing pulses and the filter did not allows retriggering of the one-shot timers 70*b*, as indicated at F5. The number missing pulses between pulse trains PT3 and PT4 in FIG. 8 is greater than the selected minimum number of missing pulses and allow the output of the filter 60*b* to decrease as shown at F6 and retrigger of the one-shot timer 70*b* as indicated at T2 in the curve labeled OT in FIG. 8**.

The difference amplifier 80 and integrating capacitor 81, produce an analog output voltage that increases as shown at 01 and 02 in the chart 00A in response to pulses as shown at T1 and T2 from the one-shot timer **70*b* and conversely decreases in response to pulses (not shown) from the one-shot timer 70*c***, to thereby variably increase and decrease the motor speed.

As previously described, the output of one-shot timers **70*b* and 70*c* are applied to the ramp and hold circuit 79 that includes difference amplifier 80, integrating capacitor 81 and null amplifier 82. As shown in FIG. 7, output of one-shot timer 70*b* is applied through a resistor 75 to the non-inverting input of the difference amplifier 80 and the output of one-shot timer 70*c* is applied through resistor 76 and diode 77 to the inverting input of the difference amplifier 80. The integrating capacitor 81 is connected from the output of the difference amplifier 80 to the inverting input the difference amplifier 80. The difference amplifier 80 is preferably a current differencing input amplifier in which the input currents are differenced at the-inverting input terminal, for example operational amplifier marketed by National Semiconductor Corporation under the designation LM 3900. The current input differencing amplifier allows controlling charging and discharging of the integrating capacitor with positive voltages. The LM 3900 has four independent, dual input amplifiers designed to operate off a single power supply, and the operational amplifier 82 in the hold circuit is conveniently on the same LM 3900 chip. The output of the ramp and hold circuit 79 is applied to the non-inverting input of amplifier 84 configured as a voltage follower amplifier with the output connected back to the inverting input, and the output of amplifier 84 is applied through resistor 85 and the diode 86 to the voltage divider 87. The adjustable tap on the voltage divider 87 is connected to the non-inverting input of amplifier 88 configured as a voltage follower with its output connected back to the non-inverting input, and the output of amplifier 88 is applied through a diode 87 to the terminal 95 of the output terminal pair 95,96. Output terminals 95 and 96 are connected to the motor controller (not shown) for motor 13**.

The first and second limit beam sensors **20*a* and 20*d* respectively sense when the slack loop reaches a selected upper limit and a selected lower limit. When the stock feed apparatus is advancing stock into the loop, it is necessary to increase the rate of feed as the size of the stock loop decreases and to decrease the rate of feed of stock as the size of the stock loop increases. Conversely, when the stock feed apparatus is withdrawing stock from the loop, it is necessary to decrease the rate of feed of stock as the stock loop decreases and increase the rate of feed of stock when the stock loop increases. The payout-rewind switch 40 effects reversal of the connections between the first and second control beam sensors to the missing pulse detectors 50*b* and 50*c* and also reverses the connections between the first and second limit beam sensors 21*a* and 21*d* to the missing pulse detectors 50*a* and 50*d*. The one-shot timers 70*b* and 70*c* apply output pulses to the difference amplifier 80 and integrating capacitor 81 to produce an analog motor speed control voltage that respectively increases and decreases the speed of the motor and the hold circuit reduces drift in the integrating capacitor to maintain the analog motor speed control voltage during intervals between pulses from either timer 70*b* or 70*c*. The J-K flip-flop 90*a* is operative when triggered to apply a selected run voltage to the motor to drive the motor at a selected high speed and the J-K flip-flop 90*d***, when triggered, pulls the output voltage to the motor down to zero to stop the motor.

As will be seen, the missing pulse detector **50*b*, filter 60*b* and time 70*b* are operative in response to sensing of a preselected number of missing pulses by one of the control beam sensors to produce a first control pulse that is applied to the non-inverting input of the difference amplifier 80. The missing pulse detector 50*c*, filter 60*b* and timer 70*b* are operative in response to sensing of a preselected number of missing pulses by the other of the control beam sensors, to produce a second control pulse that is applied to the inverting input of the difference amplifier 80. The difference amplifier 80, integrating capacitor 81 and the hold circuit including operational amplifier 82 are part of the ramp and hold circuit 79 which produces an analog motor speed control voltage that increases in amplitude in response to output pulses from one-shot timer 70*b* and decreases in amplitude in response to pulses form one-shot timer 70*c***.

The missing pulse detector **50*a*, filter 60*a*, timers 70*a* and J-K flip-flop 90*a* are operative when a preselected number of missing pulses are sensed by one of the limit beam sensors, to apply a preselected high voltage to the output 95, to run the feed drive motor at a preselected high speed. The missing pulse detector 50*d*, filter 60*d*, timer 70*d* and J-K flip flop 90*d*** are operative when a preselected number of missing pulses are sensed by the other limit beam sensor, to stop the motor.

The embodiments of the invention in which exclusive property or privilege is claimed is defined as follows:

1. In combination, a stock feed apparatus for feeding strip stock along a lengthwise path to or from a stock processing machine to maintain a slack loop in the stock, loop sensing means for sensing the size of the slack loop in the stock, and motor means for driving the stock feed apparatus, the improvement wherein the loop sensing means includes a plurality of vertically spaced beam emitters mounted at one side of an upright plane containing said lengthwise path of the strip stock and a plurality of vertically spaced beam sensors mounted at an opposite side of said upright plane and spaced from the beam emitters in a direction crosswise of said upright plane, the beam emitters and beam sensors being arranged in emitter-sensor pairs with the beam emitter of each emitter-sensor pair vertically offset from the beam sensor and configured such that a line between the beam emitter and the beam sensor of each emitter-sensor pair extends across said upright plane at an acute angle to a horizontal plane, and motor control means responsive to the loop sensing means for controlling the motor means to maintain a slack loop in the stock.

2. The combination of claim 1 wherein the emitter-sensor pairs include a first control emitter-sensor pair located above a preselected loop reference level and a second control emitter-sensor pair located below the preselected loop reference level, the motor control means including first means responsive to interruption of a beam between one of the control emitter-sensor pairs for producing a first control signal, second means operative when the stock loop interrupts a beam between an other of the control emitter-sensor pairs for producing a second control signal, and means responsive to said first and second control signals for producing a motor speed control output representative of the difference between said first and second control signals.

3. The combination of claim 2 including payout-rewind switch means operative in a payout mode: (a) to connect the beam sensor of the first control emitter-sensor pair to the means for producing the first control signal, and (b) to connect the beam sensor of the second emitter-sensor pair to the means for producing the second control signal, the payout-rewind switch means for being operative in a rewind mode, (c) to connect the beam sensor of the first control emitter-sensor pair to the means for producing the second control signal, and (d) to connect the beam sensor of the second control emitter-sensor pair to the means for producing the first control signal.

4. The combination of claim 1 wherein the beam emitters are infrared beam emitters and the beam sensors are infrared beam sensors, oscillator means for energizing the infrared emitters to transmit a train of pulses at a preselected frequency, the motor control means including means individual to each emitter-sensor pair for detecting missing pulses in the train of pulses transmitted from the infrared beam emitter to the infrared beam sensor of the each emitter-sensor pair.

5. The combination of claim 1 wherein a first of the emitter-sensor pairs is located above a preselected loop reference level, a second of the emitter-sensor pairs is located below the preselected loop reference level, pulse generating means for energizing the beam emitters to transmit a train of pulses at a preselected frequency, the motor control means including first means for sensing missing pulses in the train of pulses received by the infrared beam sensor of one of the control emitter-sensor pairs and responsive to sensing of a preselected number of missing pulses for producing a first control signal, the motor control means including second means for sensing missing pulses in the train of pulses received by the infrared beam sensor of an other of the control emitter-sensor pairs and responsive to sensing of a preselected number of missing pulses for producing a second control signal, and difference integrating circuit means having first and second inputs respectively responsive to the first and second control signals for producing an output representative of the difference between said first and second control signals.

6. The combination of claim 5 including payout-rewind switch means operative in a payout mode: (a) to connect the sensor an the first control emitter-sensor pair to the means for producing the first control signal, and (b) to connect the sensor of the second control emitter-sensor pair to the means for producing the second control signal, the payout-rewind switch means being operative in a rewind mode, (c) to connect the sensor of the first control emitter-sensor pair to the means for producing the second control signal, and (d) to connect the sensor of the second control emitter-sensor pair to the means for producing the first control signal.

7. The combination of claim 1 wherein each of the beam emitters are infrared beam emitters and the beam sensors are infrared beam sensors, pulse generator means for energizing the infrared beam emitters to transmit a train of pulses at a preselected frequency, a first of the emitter-sensor pairs being located above a preselected loop reference level, a second of the emitter-sensor pairs being located below the preselected loop reference level, the motor control means including: (a) first means for sensing missing pulses in the train of pulses received by the infrared beam sensor of one of the emitter-sensor pairs and operative each time a preselected number of missing pulses are sensed for producing a first control pulse, (b) second means for sensing missing pulses in the train of pulses received by the infrared beam sensor in the other of the emitter-sensor pairs and operative each time a preselected number of missing pulses are sensed by the second means for producing a second control pulse, and (c) difference integrator circuit means having a first input connected to the first control means and a second input connected to said second control means and responsive to said first and second control pulses for producing an output representative of the difference between said first and second control pulses.

8. The combination of claim 1 wherein the loop sensing means includes a first limit emitter-sensor pair at an upper loop limit, a first control emitter-sensor pair spaced below the first limit emitter-sensor pair and above a loop reference level, a second control emitter-sensor pair spaced below the loop reference level, and a second limit emitter-sensor pair spaced below the second control emitter-sensor pair at a lower loop limit, pulse generator means for energizing the beam emitters to transmit a train of pulses at a preselected frequency, the motor control means including: (a) means for sensing missing pulses in the train of pulses received by the beam sensor of each of the emitter-sensor pairs, (b) first control means responsive to sensing a preselected number of missing pulses by the beam sensor of one of the control emitter-sensor pairs for producing a first control pulse, (c) second control means responsive to sensing a preselected number of missing pulses by the beam sensor of the other of the control emitter-sensor pairs for producing a second control pulse, (d) output circuit means for controlling the motor means, (e) ramp and hold circuit means having a first input connected to the first control means and a second input connected to the second control means for producing and applying an analog output voltage to the output circuit means correlative with the difference between the first and second control pulses to vary the speed of the motor means, (f) first limit means responsive to sensing a preselected number of missing pulses in the train of pulses received by the beam sensor of one of the limit emitter-sensor pairs for producing a first limit signal, means responsive to said first limit signal for applying a first preset voltage to the output circuit means to operate the motor means at a first preset speed, (g) second limit means responsive to sensing a preselected number of missing pulses in the train of pulses received by the beam sensor of the other of the limit emitter-sensor pairs for producing a second limit signal, means responsive to said second voltage to the output circuit means to operate the motor means at second preset speed.

9. The combination of claim 8 including payout-rewind switch means operative in a payout mode: (a) to connect the sensor of the first control emitter-sensor pair to the first control means; (b) to connect the sensor of the second emitter-sensor pair to the second control means; (c) to connect the sensor of the first limit emitter-sensor pair to the first limit means, and (d) to connect the sensor of the second limit emitter-sensor pair to the second limit means, the payout-rewind switch being operative in the rewind mode: (e) to connect the sensor of the first control emitter-sensor pair to the second control means; (f) to connect the sensor of the second control emitter-sensor pair to the first control means; (g) to connect the sensor of the first limit sensor pair to the second limit means, and (h) to connect the sensor of the second limit emitter-sensor pair to the first limit means.

10. The combination of claim 8 wherein, the means responsive to the second limit signal includes resettable means configured for actuation by said second limit signal from a first to a second condition.

11. The combination of claim 10 including means responsive to any one on said first control signal, said second control signal or said first limit signal for actuating said resettable means to the first condition.

12. The combination of claim 11 including adjustable pulse generator means having an output connected to the first input of the ramp and hold circuit means, and power-up circuit means for actuating the adjustable pulse generator means.

13. The combination of claim 12 including means responsive to said power-up circuit means for actuating said resettable means to the first condition.

14. The combination of claim 13 including payout-rewind switch means operative in a payout mode: (a) to connect the sensor of the first control emitter-sensor pair to the first control means; (b) to connect the sensor of the second emitter-sensor pair to the second control means; (c) to connect the sensor of the first limit emitter-sensor pair to the first limit means, and (d) to connect the sensor of the second limit emitter-sensor pair to the second limit means, the payout-rewind switch being operative in the rewind mode; (e) to connect the sensor of the first control emitter-sensor pair to the second control means; (f) to connect the sensor of the second emitter-sensor pair to the first control means; (g) to connect the sensor of the first limit sensor pair to the second limit means, and (h) to connect the sensor of the second limit emitter-sensor pair to the first limit means.

15. In combination, a stock feed apparatus for feeding strip stock along a length-wise path to or from a stock processing machine to maintain a slack loop in the stock, loop sensing means for sensing the size of the slack loop in the stock, and motor means for driving the stock feed apparatus, the improvement wherein the loop sensing means includes a plurality of vertically spaced infrared beam emitters mounted at one side of an upright plane containing said lengthwise path of the strip stock and a plurality of vertically spaced infrared beam sensors mounted at an opposite side of said upright plane and spaced from the emitters in a direction crosswise of said upright plane, the beam emitters and infrared beam sensors being arranged in emitter-sensor pairs with the infrared beam emitter of each emitter-sensor pair vertically offset from the beam sensor and configured such that a line between the emitter and the sensor of each emitter-sensor pair extends across said upright plane at a acute angle to a horizontal plane, pulse generator means for energizing the infrared beam emitters to transmit a train of pulses at a preselected frequency, a first of the emitter-sensor pairs being located above a preselected loop reference level, a second of the emitter-sensor pairs being located below the preselected loop reference level, first control means for sensing missing pulses in the train of pulses received by the infrared beam sensor of one of the emitter-sensor pairs and operative each time a preselected number of missing pulses are sensed by the first control means for producing a first control pulse, second control means for sensing missing pulses in the train of pulses received by the infrared beam sensor of the other of the emitter-sensor pairs and operative each time a preselected number of missing pulses are sensed by the second control means for producing a second control pulse, ramp and hold circuit means having a first input connected to the first control means and a second input connected to said second control means and responsive to said first and second control pulses for producing an analog output voltage correlative with the difference between said first and second control pulses, and motor speed control circuit means responsive to said analog output voltage for driving the motor means at a speed correlative with said analog output voltage.

16. In combination, a stock feed apparatus for feeding strip stock along a length-wise path to or from a stock processing machine to maintain a slack loop in the stock, loop sensing means sensing the size of the slack loop in the stock and motor means for driving the stock feed apparatus, the improvement wherein the loop sensing means includes a plurality of vertically spaced infrared beam emitters mounted at one side of an upright plane containing said lengthwise path of the strip stock and a plurality of vertically spaced infrared beam sensors mounted at an opposite side of said upright plane and spaced from the emitters in a direction crosswise of said upright plane, the infrared beam emitters and infrared beam sensors being arranged in emitter-sensor pairs with the emitter of each emitter-sensor pair vertically offset from the sensor and configured such that a line between the emitter and the sensor of each emitter-sensor pair extends across said upright plane at an acute angle to a horizontal plane, the emitter-sensor pairs including a first limit emitter-sensor pair at an upper loop limit, a first control emitter-sensor pair spaced below the first limit emitter-sensor pair and above a loop reference level, a second control emitter-sensor pair spaced below the loop reference level, and a second limit emitter-sensor pair spaced below the second control emitter-senor pair at a lower loop limit, pulse generator means for energizing the infrared beam emitters to transmit a train of pulses at a preselected frequency, motor control means including (a) means for sensing missing pulses in the train of pulses received by the infrared beam sensor of each of the emitter-sensor pairs, (b) first control means operative each time a preselected number of missing pulses are sensed by the infrared beam sensor of one of the control emitter-sensor pairs for producing a first output pulse, (c) second control means operative each time a preselected number of missing pulses are sensed by the infrared beam sensor of the other of the control emitter-sensor pairs for producing a second output pulse, (d) output circuit means for controlling the motor means, (e) ramp and hold circuit means having a first input connected to the first control means and a second input connected to the second control means for producing and applying an analog voltage to the output circuit means correlative with the difference between the first and second output pulses to vary the speed of the motor means, (f) first limit means responsive to sensing a preselected number of missing pulses in the train of pulses received by the sensor of one of the limit emitter-sensor pairs for producing a first limit signal, first resettable means operative from a first condition to a second condition in response to said first limit signal for applying a first preset voltage to the output circuit means for operating the motor means at a first speed, and (h) second limit means responsive to sensing a preselected number of missing pulses in the train of pulses received by the sensor of the other of the limit emitter-sensor pairs for producing a second limit signal, (i) second resettable means operative from a first condition to a second condition in response to said second limit signal for applying a second preset voltage the output circuit means to operate the motor means at a second preset speed, (j) means responsive to any one of the first limit signal, the first control signal or the second control signal for actuating the second resettable means from the second condition to a first condition.

17. The combination of claim 16 including means connected to said second control means for actuating the first resettable means from the second to the first condition.

18. The combination of claim 16 including adjustable pulse generator means having an output connected to the first input of the ramp and hold circuit means, and power-up circuit means for actuating the adjustable pulse generator means.

19. The combination of claim 16 including payout-rewind switch means operative in a payout mode: (a) to connect the sensor of the first control emitter-sensor pair to the first control means; (b) to connect the sensor of the second emitter-sensor pair to the second control means; (c) to connect the sensor of the first limit emitter-sensor pair to the first limit means, and (d) to connect the sensor of the second limit emitter-sensor pair to the second limit means, the payout-rewind switch being operative in the rewind mode; (e) to connect the sensor of the first control emitter-sensor pair to the second control means; (f) to connect the sensor of the second control emitter-sensor pair to the first control means; (g) to connect the sensor of the first limit sensor pair to the second limit means, and (h) to connect the sensor of the second limit emitter-sensor pair to the first control means.

* * * * *

UNITED STATES PATENT AND TRADEMARK OFFICE

CERTIFICATE OF CORRECTION

PATENT NO. : 5,713,533

DATED : February 3, 1998

INVENTOR(S) : Richard D. Nordlof and Kenneth J. Lauterbach

It is certified that error appears in the above-identified patent and that said Letters Patent is hereby corrected as shown below:

In Claim 8, column 11, line 3, after "said" and before "second" insert --second limit signal for applying a--.

Signed and Sealed this

Twenty-eighth Day of April, 1998

Bruce Lehman

*Attest:*

BRUCE LEHMAN

*Attesting Officer*

*Commissioner of Patents and Trademarks*